US008857314B2

(12) United States Patent
Tasyagan

(10) Patent No.: US 8,857,314 B2
(45) Date of Patent: Oct. 14, 2014

(54) AIR PUMP PRODUCING HIGH PRESSURE

(76) Inventor: Bahtiyar Tasyagan, Kemalpasa Izmir (TR)

( * ) Notice: Subject to any disclaimer, the term of this patent is extended or adjusted under 35 U.S.C. 154(b) by 953 days.

(21) Appl. No.: 13/002,347

(22) PCT Filed: Aug. 13, 2008

(86) PCT No.: PCT/TR2008/000097

§ 371 (c)(1),
(2), (4) Date: Jan. 6, 2011

(87) PCT Pub. No.: WO2010/019108

PCT Pub. Date: Feb. 18, 2010

(65) Prior Publication Data

US 2011/0100208 A1 May 5, 2011

(51) Int. Cl.

| | |
|---|---|
| ***F01B 31/00*** | (2006.01) |
| ***F01B 29/00*** | (2006.01) |
| ***F04B 33/00*** | (2006.01) |

(52) U.S. Cl.
CPC ..... *F04B 33/00* (2013.01)
USPC ..... 92/58.1; 92/128

(58) Field of Classification Search
USPC ..... 60/58.1, 128; 417/527, 528, 555.1, 572; 92/58.1, 128
See application file for complete search history.

(56) References Cited

U.S. PATENT DOCUMENTS

| | | | | |
|---|---|---|---|---|
| 1,356,160 | A * | 10/1920 | Lawley | 92/58.1 |
| 1,491,388 | A * | 4/1924 | Foster | 417/555.1 |
| 2,469,328 | A | 5/1949 | Russell | |
| 5,433,136 | A | 7/1995 | Lung-Po | |
| 5,885,061 | A | 3/1999 | Olofsson et al. | |
| 6,702,556 | B2 | 3/2004 | Axelsson | |
| 2003/0086802 | A1 | 5/2003 | Tsai | |

FOREIGN PATENT DOCUMENTS

| | | |
|---|---|---|
| GB | 2102507 A | 2/1983 |
| GB | 2398354 A | 9/2005 |

OTHER PUBLICATIONS

International Search Report for PCT/TR2008/000097, conducted by the European Patent Office on Apr. 29, 2009, mailed Nov. 5, 2009.
International Preliminary Report on Patentability for PCT/TR2008/000097, European Patent Office, Feb. 15, 2011.

* cited by examiner

*Primary Examiner* — Micheal Leslie
(74) *Attorney, Agent, or Firm* — Oppedahl Patent Law Firm LLC

(57) ABSTRACT

Manually operated air pump for multistage compression of ambient air comprises a multiple coaxial cylinder arrangement. The air inlet (3) is located in the pump handle (2), through which air passes to enter the pump. The pump handle further includes a dust and humidity filter (21) and a cavity (20) to be used as tool storage.

8 Claims, 6 Drawing Sheets

AIR PUMP PRODUCING HIGH PRESSURE

BACKGROUND OF THE INVENTION

1. Field of the Invention

The invention relates to air pumps producing high pressure and providing efficient and ergonomic use in the ground conditions.

2. Background Art

Nowadays, there are pumps which produce high pressure for filling guns and aqualungs. The working process of these pumps is as follows: chambers in the air pump are conjoined from bigger to smaller; air into the air pump is guided to the biggest chambers through to the smallest chamber and fills the tubes with high pressure air.

For example, U.S. Pat. No. 5,885,061; discloses a pump in which the air moves from the pump body into the pump; guided to the chambers in order from bigger chambers to the smaller chamber and fills in to the tubes.

Also U.S. Pat. No. 6,702,556; discloses that the air into the air pump is guided through the chambers by air valves and o-rings and fills into the tubes.

However, in the above-mentioned patent specifications; there are no disclosed barometers or other gauges which measure the pressure of the air when guided through the bigger chamber to the smaller chamber filling into the tubes; also there are no filters disclosed to filter the air from dust and such materials before the air gets into the pump.

To address these issues, some technical improvements have been made; one of those improvements is disclosed in English Patent Specification number GB 2398354, in which the air into the pump is first filtered by an air filter and guided through the bigger chamber to the smaller chamber by the air valves and o-rings and fills into the tubes as intended. Also, there is a barometer which measures pressure in the pump.

The present disclosure further provides that within the air pump producing high pressure; it is disclosed that the air pump producing high pressure includes a reservoir, cavity, or compartment to store parts, make the pump pillar more ergonomic for the user, and provide fast and easy set up.

BRIEF SUMMARY OF THE INVENTION

The object of this invention is to produce a high pressure air filter that contains a reservoir in the pump handle which provides more comfortable and ergonomic usage and also provides more efficient usage because the air filter is built into the pump handle.

Another object of this invention is to produce an easily disconnected/connected air pump producing high pressure for users in ground conditions.

Another object of the invention is to provide an air pump producing high pressure wherein the pump pillar provides ergonomic configuration for users.

BRIEF DESCRIPTION OF THE DRAWINGS

An embodiment of the high pressure air pump is shown as follows.

Figure 1:
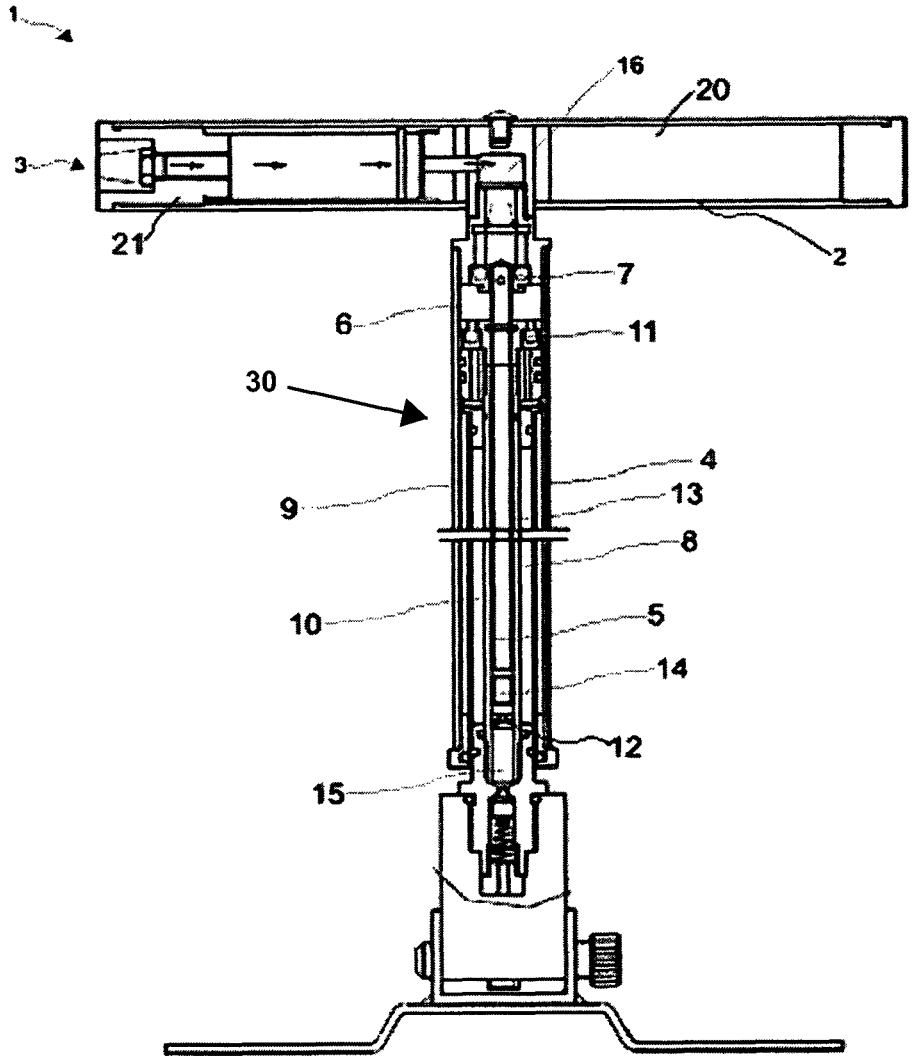
FIG. 1 is a vertical sectional view of an embodiment of the air pump producing high pressure.
Figure 2:
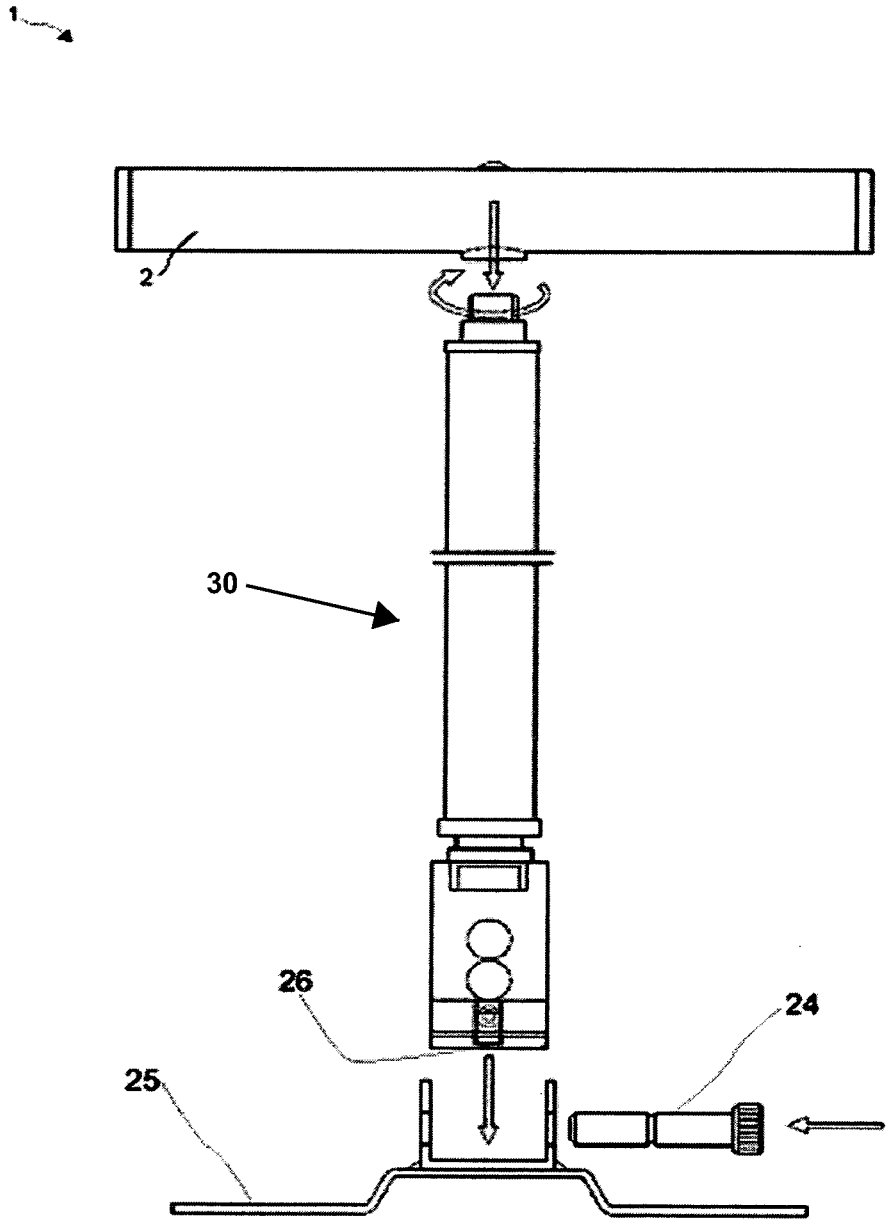
FIG. 2 is an exploded schematic view of the device of FIG. 1.
Figure 3:
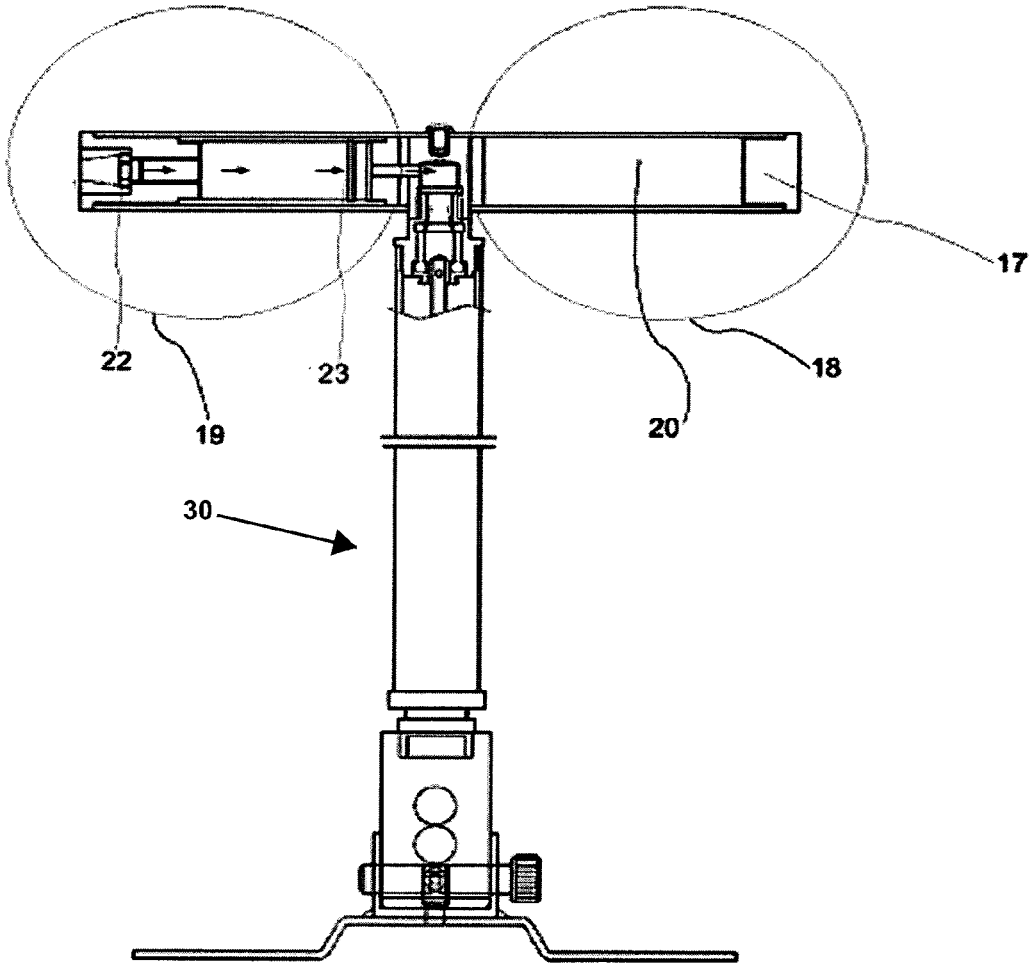
FIG. 3 is another perspective view of the device of FIG. 1.
Figure 4:
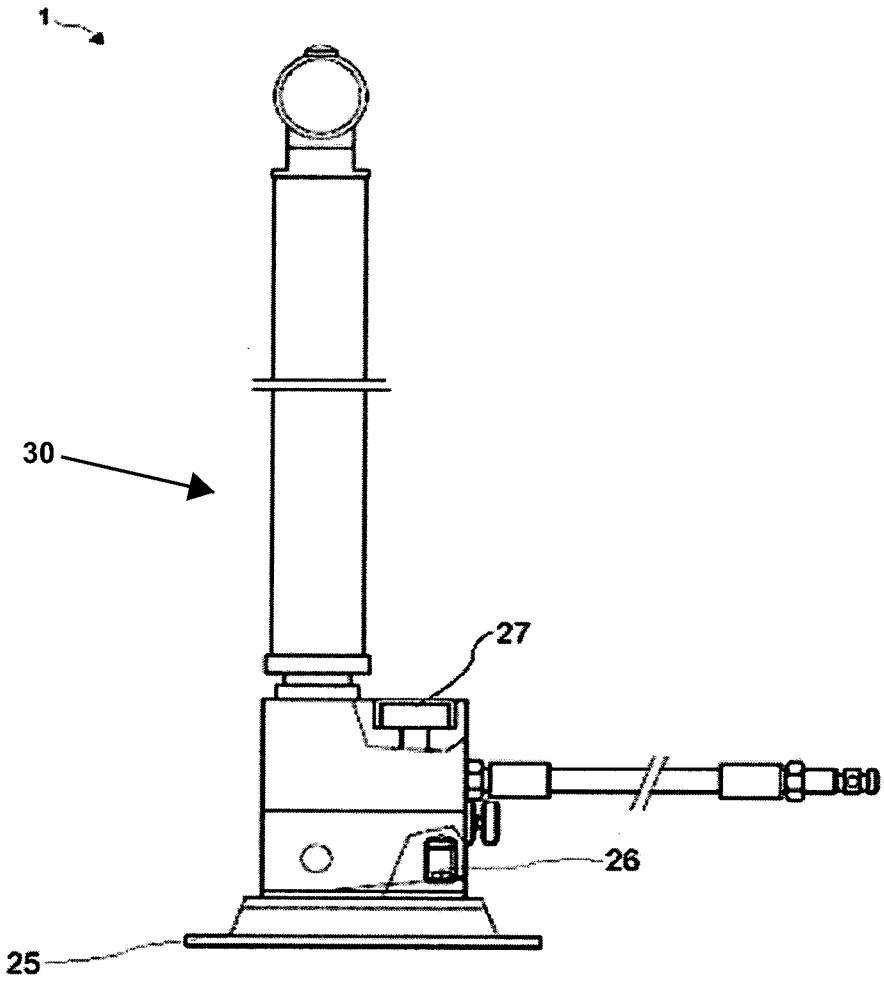
FIG. 4 is a perspective view of the pump parts which are mounted to the device of FIG. 1.
Figure 5:
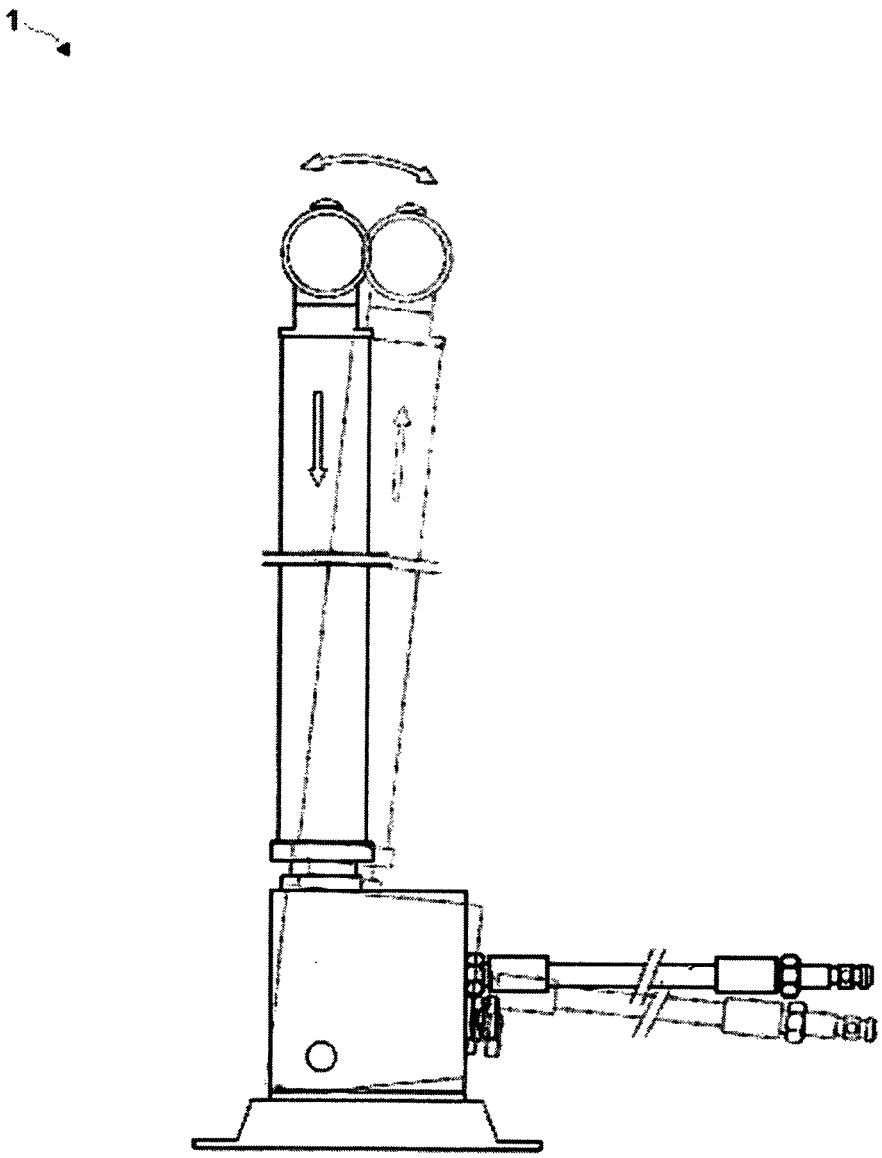
FIG. 5 is a perspective view of the hinge of the device of FIG. 1 during action.
Figure 6:
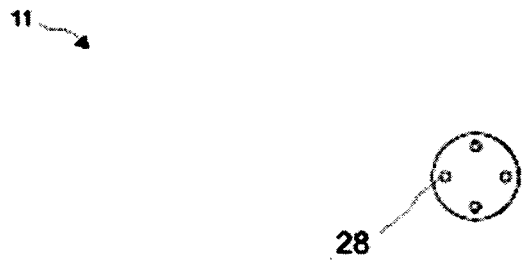
FIG. 6 is a top view of the air direction valve of the device of FIG. 1.
Figure 7:
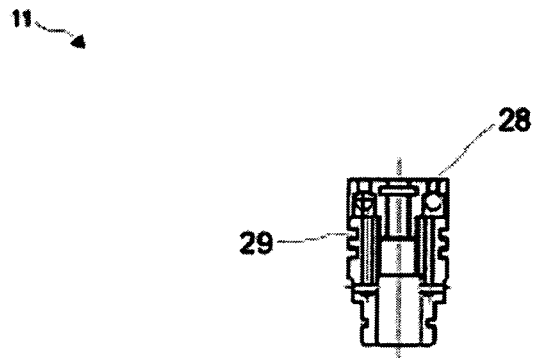
FIG. 7 is a side view of the air direction valve of the device of FIG. 1.

The parts of the above-mentioned air pump producing high pressure are numbered and listed as follows:

1. Air pump producing high pressure
2. Handle
3. Slot
4. External pipe
5. Piston rod
6. First chamber
7. Air inlet valve
8. Second standpipe
9. Second chamber
10. Third chamber
11. Air direction valve
12. Moving o-ring
13. First standpipe
14. Piston
15. Fourth chamber
16. Connector
17. Cover
18. First part
19. Second part
20. Reservoir
21. Air filter
22. First filter cartridge
23. Second filter cartridge
24. Dowel
25. Mooring pin
26. Screw
27. Pressure gauge
28. Gutter
29. Standing o-ring

DETAILED DESCRIPTION OF THE INVENTION

The above-mentioned air pump producing high pressure (1) contains a pump handle (2), a body (30) and a mooring pin (25). Pump handle (2) includes an air inlet slot (3). Pulling the pump handle upwards allows air through the air inlet slot (3) and into the body (30). Air enters the body (30) through a first chamber (6) which fills with air through the air inlet slot (3); also located between the movable external pipe (4) and the piston rod (5); air inlet valve (7) which is closed by the internal pressure when the pump handle (2) is pushed; the second chamber (9); in which the air in the first chamber (6) enters through open, air direction valves (11); also located between the movable external pipe (4) and the second standpipe (8); the third chamber (10) located between the first stand pipe (13) and the piston rod (5); the smallest volume fourth chamber (15); located at the far end of the first stand pipe (13); (which is the last place where the air in second chamber and the third chamber passes through last before the tube when the direction valves closed because the pressure occurs when the pump handle is pulled upwards again and valve with the movable o-ring on the piston rod opened); and the piston (14); the pump handle (2); which has a dust and moisture filter; a reservoir; and guides the air in the fourth chamber to get through the tube by closing the o-ring (12) valve to avoid the air passes through the second and third chamber when pushed again.

Air direction valve (11) contains a channel which has rounded elements to guide the air passing through the chambers and at least an o-ring separating the chambers.

Pump handle (2) separated into two part by the pump connector (16) which mounted in the middle of the handle; also contains the reservoir (20) which is placed under the cover (17) on the first section (18) of the handle and an air filter (21) which filters the dust and the damp of the air which get into the second section (19).

User can put the maintenance and repair kit and spare parts or other items into the reservoir and carry the items in a safe condition.

Air filter (21) of the invention related air pump producing high pressure (1); contains the first filter cartridge (22) which filters the dust in air and the second filter cartridge (23) which filters air moisture.

The first filter cartridge (22) and the second filter cartridge (23) can be easily removed periodically and easily replaced with the new ones by the user.

The pump handle (2) of the air pump producing high pressure (1) can be removed from the pump body (30) by rotating. The mooring pin (25) can be removed from body (30) by pulling the dowel (24). Thus, the pump (1) can be easily assembled and disassembled. In one embodiment, the air pump producing high pressure (1) contains an adjustment screw (26) which is mounted between the mooring pin (25) and the body (30). The adjustment screw (26) can be used to adjust the pump according to the user's joint movements so the user can move and use the pump (1) more easily.

The pressure gauge (27) of the invention related air pump producing high pressure (1); is embedded into the body (30) to avoid external damages for example if the pump (1) is dropped.

While a number of exemplary aspects and embodiments have been discussed above, those of skill in the art will recognize certain modifications, permutations, additions and sub-combinations therefor. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

The invention claimed is:

1. An air pump for producing high pressure comprising:

a pump handle;

a body;

and a mooring pin;

said pump handle comprising an air inlet slot;

said pump handle further comprising an air filter for the filter of dust and humidity and a reservoir for putting tools;

said body comprising a biggest volume first chamber positioned between a movable external pipe and a piston rod;

said body further comprising a second chamber positioned between the movable external pipe at a smaller volume and a second standpipe;

said body further comprising a third chamber positioned between an inner side portion of a first standpipe and the piston rod;

said body further comprising a fourth chamber at the smallest volume positioned at the end of the piston rod and first standpipe;

wherein said first chamber is filled with air by means of passing through the air inlet slot in the pump handle by means of pulling the pump handle upwards;

wherein the air passes through the first chamber by means of air direction valves opening and closing by means of compressing the air by pushing the pump handle;

wherein the air in the second and the third chambers passes lastly before a tube by means of a valve with a movable o-ring member at the piston rod being opened and the air direction valves being closed by means of the pressure occurring as a result of pulling the pump handle upwards again;

and wherein the air in the fourth chamber is provided to pass to the tube by means of preventing the air to pass to the second and the third chambers by the valve with o-ring member being dosed when the pump handle is pulled again.

2. The air pump producing high pressure according to claim 1, further comprising a gutter having tubular members enabling the air passage through said first, second, third and fourth chambers, and the air direction valve having at least one standing o-ring member separating said first, second, third and fourth chambers.

3. The air pump producing high pressure according to claim 1, wherein the pump handle is separated to two parts by a pump connector in the middle of the pump handle; and wherein the air pump producing high pressure further comprises the reservoir where tools are put by taking off a cap positioned at the butt of a first part and the air filter filtering particulates and humidity in the air entering in a second part.

4. The air pump producing high pressure according to claim 1, wherein, the air filter comprising a first filter member filtering the particulates of the air entering first and a second air filter member filtering the humidity.

5. The air pump producing high pressure according to claim 1, wherein the pump handle separates from the body by rotating, and the body separates from the mooring pin by pulling a dowel, whereby the pump can be more easily disconnected/connected.

6. The air pump producing high pressure according to claim 1, further comprising an arrangement screw positioned between the body and the mooring pin, enabling the user to use the pump comfortably by adjusting the range of motion of the pump to accommodate the joint movement of the user.

7. The air pump producing high pressure according to claim 2, wherein, the air filter comprising: a first filter member filtering particulates from the air entering the air filter and a second air filter member filtering the humidity from the air.

8. The air pump producing high pressure according to claim 3, wherein, the air filter comprising: a first filter member filtering particulates from the air entering the air filter and a second air filter member filtering the humidity from the air.

* * * * *